United States Patent [19]

Johnson et al.

[11] Patent Number: 4,697,721

[45] Date of Patent: Oct. 6, 1987

[54] PILL STORAGE AND DISPENSING CASSETTE

[75] Inventors: Robert D. Johnson; John W. Havener; Mark F. Reyner; Franklin W. Reyner, Jr.; Loren K. Whitver; Norman W. Kilburn, all of West Union, Iowa

[73] Assignee: Pharmaceutical Innovators Ltd., West Union, Iowa

[21] Appl. No.: 748,404

[22] Filed: Jun. 24, 1985

[51] Int. Cl.[4] ..... B65B 57/20

[52] U.S. Cl. ..... 221/211; 221/97; 221/203; 221/241

[58] Field of Search ..... 221/97, 174, 197, 203, 221/211, 241, 281, 200, 201; 74/54, 96; 222/238; 301/374; 193/20, 21

[56] References Cited

U.S. PATENT DOCUMENTS

| | | | |
|---|---|---|---|
| 795,676 | 7/1905 | Ammen | 222/308 |
| 1,086,429 | 2/1914 | Wetmore | 221/174 X |
| 1,775,141 | 4/1929 | Risser | 221/174 X |
| 2,113,460 | 4/1938 | Chott | 222/308 |
| 2,742,184 | 4/1956 | Yerkes et al. | 221/203 |
| 2,794,576 | 6/1957 | Reynolds | 222/238 X |
| 3,065,879 | 11/1962 | Jennings et al. | 221/241 X |
| 3,206,062 | 9/1965 | Rappaport | 221/211 X |
| 3,380,626 | 4/1968 | Giannini | 221/200 |
| 3,706,395 | 12/1972 | Havener et al. . | |
| 3,796,346 | 3/1974 | Ribouleau | 221/278 X |
| 3,861,225 | 1/1975 | Mattson | 74/54 |
| 3,946,910 | 3/1976 | Case | 222/238 |
| 4,018,358 | 4/1977 | Johnson et al. . | |
| 4,036,185 | 7/1977 | Key | 74/54 X |
| 4,449,642 | 5/1984 | Dooley | 221/211 |

FOREIGN PATENT DOCUMENTS

| | | | |
|---|---|---|---|
| 454686 | 12/1927 | Fed. Rep. of Germany | 193/21 |
| 463223 | 4/1951 | Italy | 221/203 |
| 1117223 | 6/1968 | United Kingdom | 221/200 |

*Primary Examiner*—Robert J. Spar
*Assistant Examiner*—P. McCoy Smith
*Attorney, Agent, or Firm*—Zarley, McKee, Thomte, Voorhees & Sease

[57] ABSTRACT

An improved pill storage and dispensing cassette includes front and back side walls, opposite end walls, and opposite top and bottom walls defining a storage chamber therein. A rotatable pill conveying wheel is positioned in the back side wall and has a plurality of openings for holding and conveying a pill to a discharge chute upon actuation of a remote vacuum source. A separator member is positioned over the openings of the conveying wheel to dislodge the pills from the conveying wheel and such that the pills fall through the chute into the desired receptacle. An adjustment shoe is provided so that only one pill is held and conveyed by each opening in the conveying wheel. A central wall is included within the cassette to divide the pill chamber into forward and rearward compartments with the pills being primarily stored in the forward compartment with a limited number of pills passing through a recessed area in the central wall to the rearward compartment for conveyance by the conveying wheel. An agitator is positioned within the rearward compartment for rotation in the opposite direction as the conveying wheel to agitate the pills and prevent bridging across the top surface thereof. An insert is provided at the opening of the discharge chute to direct the dislodged pills into a receiving vial. The cassette also includes an enlarged opening over which a hopper is mounted such that pills can be continually loaded into the cassette during discharge of the pills therefrom.

3 Claims, 10 Drawing Figures

PILL STORAGE AND DISPENSING CASSETTE

BACKGROUND OF THE INVENTION

In the past, dispensing of pills was a tedious and time-consuming job, wherein the pharmacist manually counted pills from a storage container and placed them in a vial. In addition to being inefficient, such procedures were subject to inaccuracies.

To overcome such problems, automatic counting and dispensing machines have been designed for more efficient and accurate distribution of pills. One such machine is described in applicants' previous U.S. Pat. No. 4,018,358 wherein a pill cassette is placed on a machine such that the cassette is in communication with a vacuum source in the machine and with a drive wheel for operating a conveying wheel in the cassette which carries pills from the bottom of a cassette to a discharge opening positioned above the vial. A photoelectric cell senses each pill carried to the discharge opening via a fiber optic scanner and an electronic counter counts the pills until the predetermined number of pills have passed through the discharge opening into the vial whereafter the machine automatically shuts down. The machine also can be used to count pills for inventory control purposes. The cassette includes an adjustable kickoff shoe adjacent to the conveying wheel for adjusting the vacuum applied to the pill such that the vacuum port of the wheel carries only a single pill to the discharge chute wherein the pill is separated from the wheel for exit through the discharge opening. The cassette also includes a rotatable agitator for preventing bridging of the pills within the chamber.

Such cassettes are subject to several problems. First, the kick-off shoe is not adjustable when the cassette is in position on the machine, and cannot be adjusted during operation of the machine. Also, the agitator rotates in the same direction as the conveying wheel such that there is a tendency for the pills to move away from the lower portion of the wheel. Furthermore, the interior of the cassette defines a single enlarged chamber and the pills therein accumulate and pile up against the conveying wheel so as to place undue pressure thereon. Also, when the machine shuts down and the vacuum therein ceases, pills carried by the conveying wheel and positioned over the discharge chute drop into the chute and exit through the discharge opening into the vial after the proper number of pills have been dispensed. Finally, there is no way to load additional pills into the cassette during operation of the machine.

Therefore, a primary objective of the present invention is the provision of an improved pill cassette for use with a pill counting machine.

Another objective of the present invention is the provision of an improved pill cassette wherein the kick-off shoe can be adjusted during operation of the pill counting machine.

Another objective is the provision of an improved pill cassette wherein the pills carried by the conveying wheel into the area above the discharge chute are quickly dropped into the chute for exit through the discharge opening after being counted.

A further objective of the present invention is the provision of a pill cassette wherein the agitator therein rotates in the opposite direction as the pill conveying wheel so as to maintain pills in contact with the lower portion of the wheel.

A further objective is the provision of a pill cassette wherein the pills, having been counted by an electric eye, will be quickly separated from the conveying wheel to insure a rapid and accurate count thereof.

Still another objective of the present invention is the provision of an improved pill cassette wherein pills will not pass through the discharge opening of the cassette after the pill counting machine is shut off.

A further objective of the present invention is the provision of an improved pill cassette wherein pressure on the pill conveying wheel is minimized.

Another objective of the present invention is the provision of an improved pill cassette which can be loaded with additional pills during the operation of the pill counting machine.

Another objective of the present invention is the provision of an improved pill cassette which is economical to manufacture and efficient and durable in use.

DETAILED DESCRIPTION OF THE DRAWINGS

Figures 1, 2, 3:
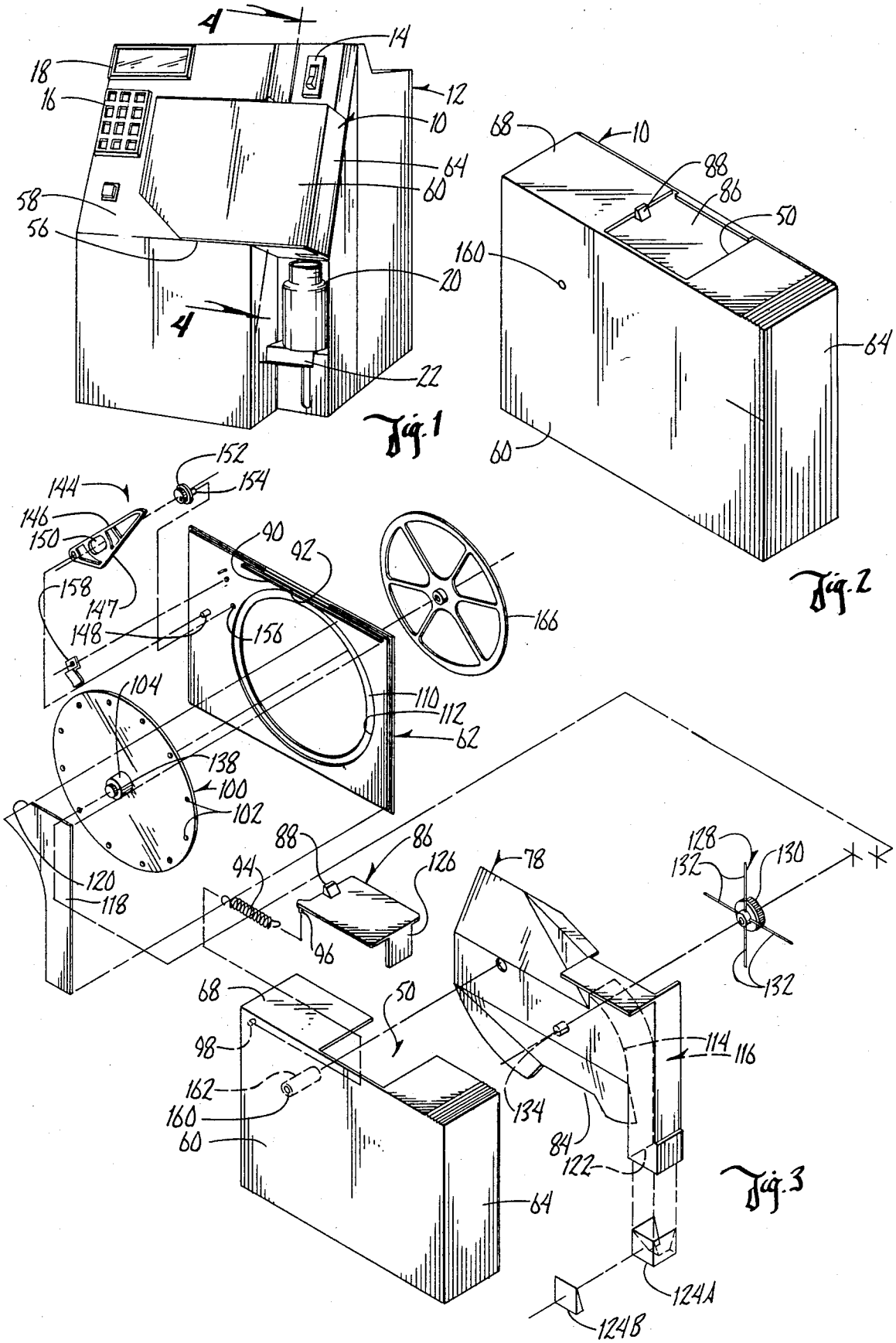
FIG. 1 is a perspective view of the pill counting machine having a pill cassette positioned therein for counting and dispensing pills into a vial.
FIG. 2 is a perspective view of the pill cassette of the present invention.
FIG. 3 is an exploded perspective view of the pill cassette.

Reference numeral 10 generally designates the improved pill cassette of the present invention which is designed for use in a pill dispensing and counting machine 12. Machine 12 is described in detail in applicants' previous U.S. Pat. No. 4,018,358 and does not constitute a part of the present invention.

Generally, machine 12 has an on-off switch 14, a digital key pad 16 in operative communication with the solid state electronics of the machine for setting the number of pills to be dispensed by the machine, and an LED display counter 18 for displaying the number of pills dispensed from the machine as sensed by a fiber optic scanner and a photo-electric cell. A vial 20 for receiving the dispensed pills is positioned on an upwardly biased spring loaded shelf 22 such that the vial is positioned adjacent the discharge opening of the cassette.

Machine 12 includes a drive system including a motor 24 having a drive shaft 26 which is connected by a pin or set screw 28 to a centering hub 30 having an outwardly extending finger 32. Integrally connected with hub 30 is a drive wheel 34 having an upstanding perimeter wall 36.

Machine 12 further includes a vacuum system (not shown) which is in communication with a first vacuum chamber 38 formed by walls 40 and 41 and an upstanding wall 42. Chamber 38 is in communication through a plurality of openings 44 in drive wheel 34 with a second vacuum chamber 46 defined by drive wheel 34 and cassette 10. A perforated plate 48 on machine 12 covers an opening 50 in cassette 10. Accordingly, the vacuum system draws air from the atmosphere through perforated plate 48 and opening 50 in cassette 10 into second vacuum chamber 46 and then through openings 44 in drive wheel 34 into first vacuum chamber 38 and then into a vacuum tube 52 connected to the vacuum system, as indicated by arrows 54 in FIG. 5.

Figure 5:
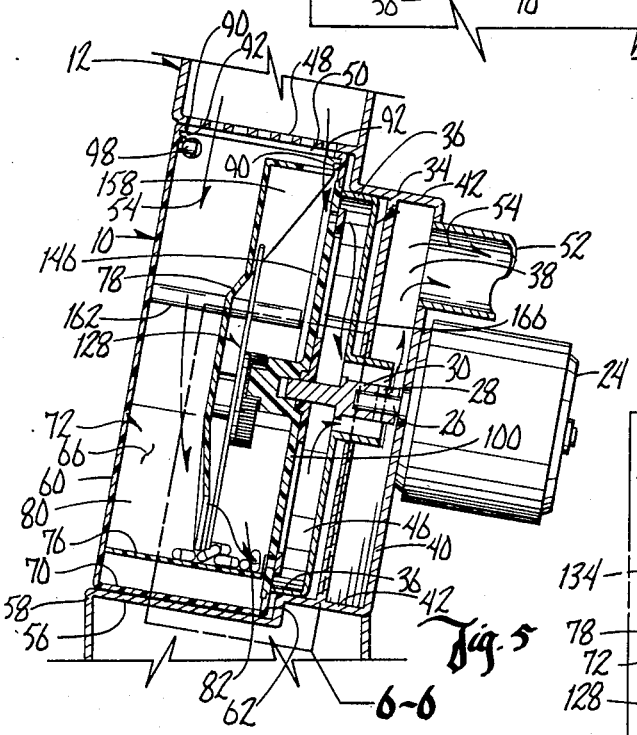
FIG. 5 is a partial sectional side elevation view of the pill cassette taken along lines 5—5 of FIG. 4.
Figure 7:
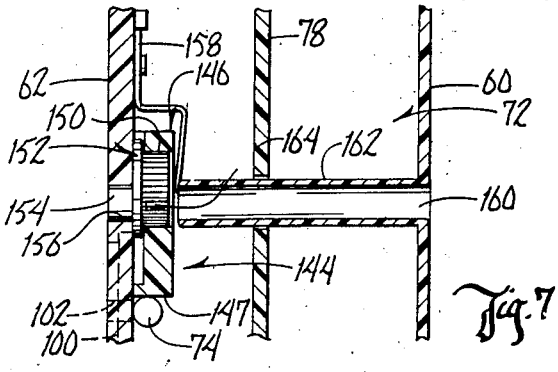
FIG. 7 is a view taken along lines 7—7 of FIG. 4.

Machine 12 has a rearwardly angled support ledge 56 and a front retaining wall portion 58 for holding cassette 10 in position thereon. As seen in FIG. 5, cassette 10 is tilted with respect to a vertical plane when in position on machine 12.

Machine 12, as described above, is substantially identical to the dispensing and counting machine described in applicants' previous U.S. Pat. No. 4,018,358 and does not constitute a part of the present invention. The present invention is embodied in the following detailed description of cassette 10.

Cassette 10 includes a front side wall 60, a back side wall 62, opposite end walls 64 and 66, a top wall 68, and a bottom wall 70 which form a pill chamber 72 for receiving a plurality of pills 74. A concave wall 76 extends between front side wall 60 and back side wall 62 so that pills 74 accumulate toward the lower portion thereof. An interior central wall 78 extends between opposite end walls 64 and 66 and between concave wall 76 and top wall 68 so as to divide chamber 72 into a forward compartment 80 and a rearward compartment 82. A recessed area 84 adjacent concave wall 76 provides communication between the two compartments. Pills 74 are primarily stored within forward compartment 80 with a limited number of pills passing by gravity through recessed area 84 into rearward compartment 82.

Top wall 68 includes a slidable door 86 for normally closing opening 50 therein. Door 86 includes an upwardly extending actuating knob 88 which engages perforated plate 48 when cassette 10 is positioned on machine 12 so as to open door 86 and expose opening 50. A flange 90 extending inwardly from each of front side wall 60 and back side wall 62 adjacent top wall 68 supports door 86 and define a groove 92 within which door 86 slides. A spring 94 has one end connected to a pin 96 extending downwardly from door 86 and an opposite end secured to a pin 98 on front side wall 60 so as to normally close door 86.

Figure 6:
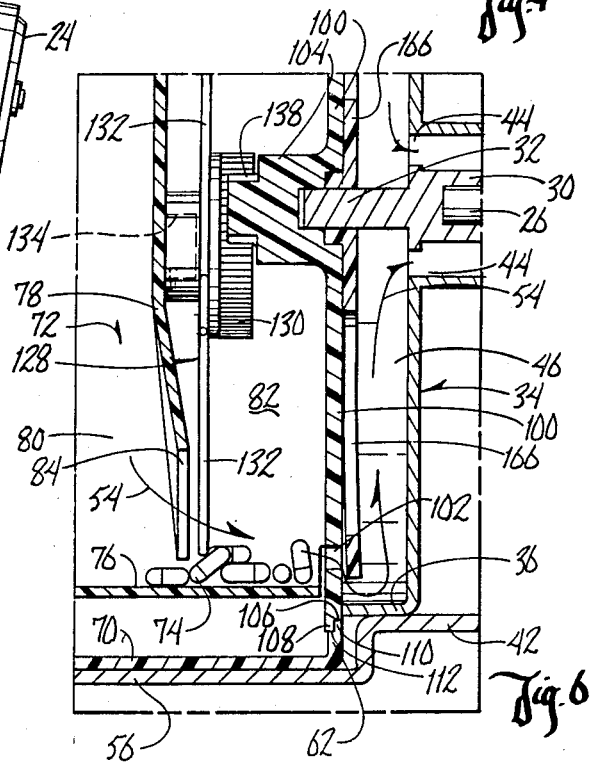
FIG. 6 is an enlarged sectional view taken along lines 6—6 of FIG. 5.

Back side wall 62 includes a pill conveying wheel 100 having a plurality of pill conveying openings 102 coaxially arranged adjacent the perimeter of the wheel. Actuation of the vacuum system of machine 12 draws air through openings 102 of wheel 100 so as to attract and hold pills to an opening 102 for conveyance by wheel 100 which is rotated by the drive system of machine 12. Wheel 100 includes a spacer post 104 at the axial center of rotation thereof which receives the hub finger 32 on drive shaft 26 of motor 24. The outer peripheral edge of wheel 100 includes a shoulder 106 and an outwardly extending annular flange 108 which matingly engages an oppositely disposed flange 110 and a shoulder 112 on back side wall 62, as best seen in FIG. 6. Flange 110 and shoulder 112 define an opening in back side wall 62 in which pill conveying wheel 100 is rotatably mounted.

Upstanding wall 36 of drive wheel 34 engages wheel 100 between openings 102 and the outer peripheral edge thereof. The vacuum applied to wheel 100 from the vacuum system of machine 12 maintains the contact between the wheel and upstanding wall 36 of drive wheel 34.

Wheel 100 is limited against movement into the chamber 72 by concave wall 76. Wheel 100 is further limited against movement into chamber 72 by a wall 114 extending rearwardly from the central wall 78 and upwardly from bottom wall 70 and spaced inwardly from end wall 64 so as to define a discharge chute 116 therebetween. Wall 114 extends upwardly from bottom wall 70 and inwardly with respect to end wall 64 so as to cross the line of travel of pills 74 carried on wheel 100. A separator plate 118 is positioned adjacent back side wall 62 and conveying wheel 100 and has a separator surface 120 which crosses the line of travel of pills 74 carried by wheel 100 so as to dislodge pills from the wheel for passage into discharge chute 116. Discharge chute 116 has a discharge opening 122 at the lower end thereof through which the dislodged pills exit into vial 20. Separator surface 120 of separator plate 118 is positioned such that when the vacuum system of machine 12 is deactuated, any pills being carried by conveying wheel 100 at the time of deactuation but not yet positioned above discharge chute 116 will drop off of conveying wheel 100 and back into rearward compartment 82 rather than into discharge chute 116 for exit through discharge opening 122 in vial 20. Thus, when machine 12 automatically shuts off after the desired predetermined number of pills have been dispensed therefrom, no additional pills will unintentionally be deposited in vial 20.

Figure 4:
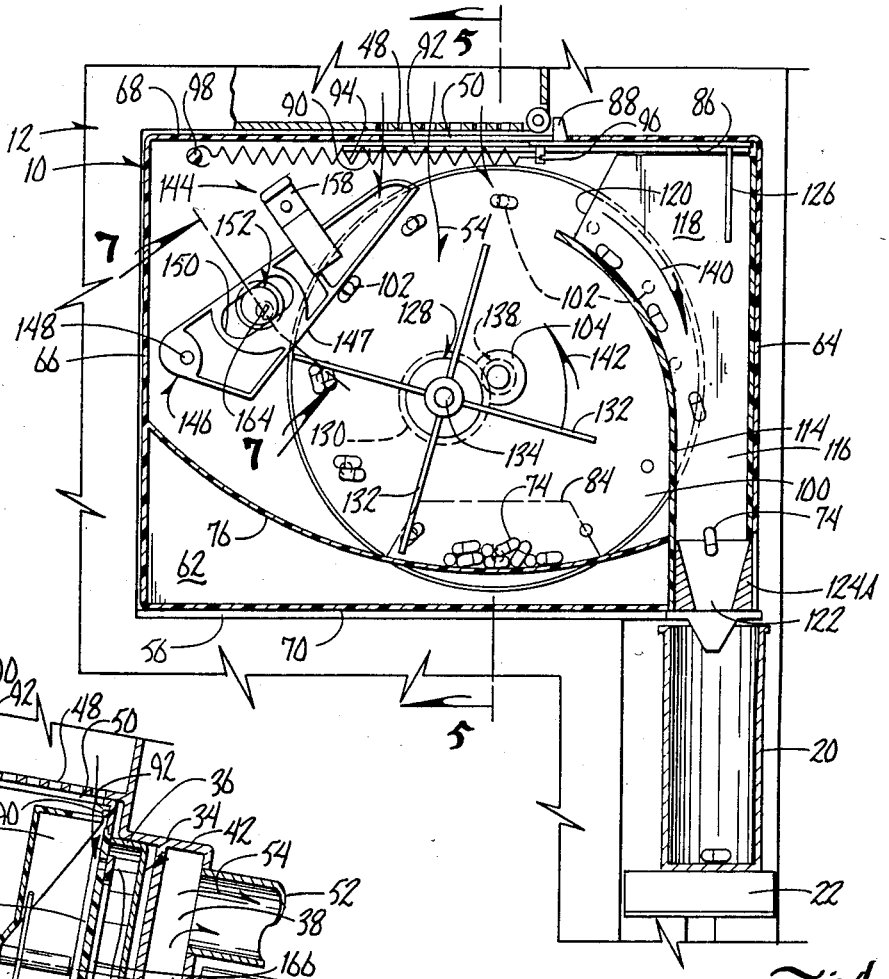
FIG. 4 is a partial sectional front elevation view of the pill cassette taken along lines 4—4 of FIG. 1.

As seen in FIGS. 3 and 4, any one of a number of plugs 124A or 124B may be inserted into discharge opening 122 so as to reduce the dimensions of the opening in accordance with the opening into vial 20 so that dislodged pills 74 exiting discharge opening 122 will fall into vial 20.

The upper end of chute wall 114 is spaced downwardly from top wall 68 so as to define an entryway into discharge chute 116. Door 86 has a member 126 extending downwardly therefrom which serves to close this entryway into discharge chute 116 when cassette 18 is not in position on machine 12. Thus, when door 86 is closed, member 126 thereon closes discharge chute 116 from pill chamber 72 such that pills 74 are sealingly stored within cassette 10 and cannot be spilled therefrom.

An agitator 128 is mounted within cassette 10 for agitation of pills 74 so as to prevent bridging of the pills within chamber 72. Preferably, agitator 128 is positioned within rearward compartment 82. Agitator 128 includes an axially molded gear 130 having a plurality of flexible fingers 132 extending therefrom. Agitator 128 is rotatably mounted on central wall 78 in any convenient manner, such as by a slip fit onto a molded post 134 of central wall 78. As best seen in FIG. 4, the axis of rotation of agitator 128 is offset with respect to the axis of rotation of conveying wheel 100. Gear 130 which is in meshing engagement with a gear 138 mounted on spacer post 104 of conveying wheel 100 such that rotation of wheel 100 in a clockwise direction as indicated by arrow 140 imparts rotation to agitator 128 in a counterclockwise direction as indicated by arrow 142. As agitator 128 rotates, fingers 132 thereof engage and mix pills 74 so as to prevent any bridging between pills. Also, by rotating agitator 128 in the opposite direction as wheel 100, the pills remain in the lowermost part of concave wall 76 for pick-up and conveying by wheel 100. It is understood that agitator 128 may take other forms without departing from the scope of the present invention.

Generally, the size of each opening 102 is sufficient to accommodate any size pill but may be too large for certain pills such that more than one pill is carried on a single opening 102 of conveying wheel 100. To prevent more than one pill from being carried on each opening 102, an adjustment means 144 is provided. Adjustment means 144 includes an elongated kick-off shoe 146 pivotally mounted upon a pin 148 on back side wall 62. Shoe 146 has a kick-off surface 147 and an elongated slot 150 therein which is adapted to receive a cam member 152. Cam member 152 has an offset pin 154 which is received within an opening 156 in back side wall 62 such that cam member 152 pivots about pin 154. Cam member 152 is generally constructed as a gear having a plurality of teeth which mesh with a plurality of teeth on slot 150 of kick-off shoe 146 such that rotation of cam member 152 about pin 154 causes shoe 146 to pivot about pin 148 such that the kick-off surface 147 adjustably moves towards and away from openings 102 in conveying wheel 100 so as to vary the size of such openings, thereby preventing more than one pill from being conveyed by wheel 100, as best seen in FIG. 4. The teeth on cam member 152 and slot 150 serve to lock the cam member, and thus kick-off shoe 146, into the desired position. A clip 158 secured to back wall 62 holds adjustment means 144 in position on back side wall 62.

It is only necessary that one of the openings 102 be partially covered by shoe 146. If too much of an opening is covered, then the openings will not carry a pill, while if too little of the opening is covered the openings may carry more than one pill for discharge into the discharge chute wherein the photoelectric cell will read more than one pill as only one pill.

Front side wall 60 has opening 160 therein to provide access to adjustment means 144 when cassette 10 is in position on machine 12. A hollow tube 162 may be integrally formed with front side wall 60 and extends through central wall 78 for directing an adjustment tool (not shown), such as a screwdriver, into a slot 164 on cam member 152 for manually rotating cam member 52 and thereby adjusting the position of kick-off surface 147 with respect to openings 102 on conveying wheel 100. Alternatively, the adjustment tool could be permanently secured to cam 152 and extend through central wall 78 and outwardly from front side wall 60. Thus, adjustment means 144 can be adjusted from the front side of cassette 10 during operation of machine 12.

Openings 102 of conveying wheel 100 are normally sealed by a ring 166 adapted to overlay the openings when the vacuum system of machine 12 is not actuated. Ring 166 is secured to spacer post 104 of conveying wheel 100 on the exterior side of the wheel. Ring 166 is constructed of resilient material so as to be pulled away from openings 102 when the vacuum system of machine 12 is actuated, thereby allowing air to pass outwardly through openings 102.

The inside of cassette 10 is maintained moisture free by the provision of a desiccant holder which is adapted to hold a cartridge of desiccant material (not shown).

In operation, motor 24 is actuated so as to rotate drive wheel 34 and conveying wheel 100. The actuation of the vacuum system of machine 12 causes atmospheric air to be drawn inwardly through perforated plate 48 and opening 50 in top wall 68 of cassette 10 and then through openings 102 of wheel 100 into second vacuum chamber 46 and then through openings 44 in drive wheel 34 into first vacuum chamber 38. Thus, an exterior suction is created through openings 102 such that a pill 74 is picked up by each opening and conveyed by the rotation of wheel 100 to the discharge chute wherein the pill is dislodged by separator surface 120 of separator plate 118 and thereafter falls through discharge chute 116 and exits discharge opening 122 so as to be counted by machine 12 as the dislodged pill is received within vial 20. Central wall 78 prevents a buildup of pills against conveying wheel 100 and thereby minimizes pressure thereon. Also, the reduced number of pills adjacent conveying wheel 100 better insures that each opening 102 will pick up a pill for conveyance to discharge chute 116. Rotation of conveying wheel 100 causes agitator 128 to rotate in the opposite direction so as to continually mix the pills so as to prevent bridging on the upper surface thereof and further enhance the ability of openings 102 to pick up a pill for conveyance to discharge chute 116. Adjustment means 144 kicks off all but one pill from each opening 102, as seen in FIG. 4, such that an accurate count of the pills dispensed from machine 12 is obtained.

Figure 8:
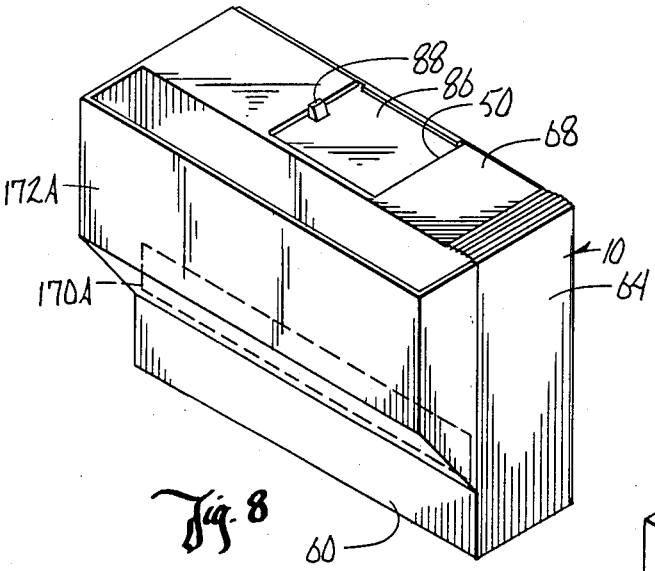
FIGS. 8 and 9 are perspective views of alternative embodiments of the improved pill cassette of the present invention.
Figure 9:
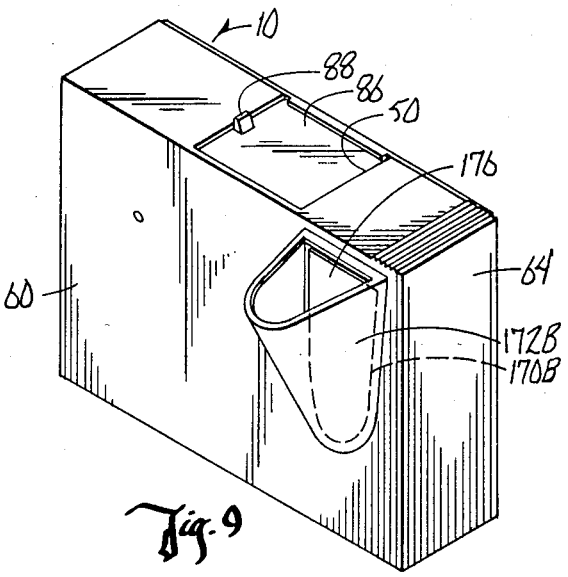
Figure 10:
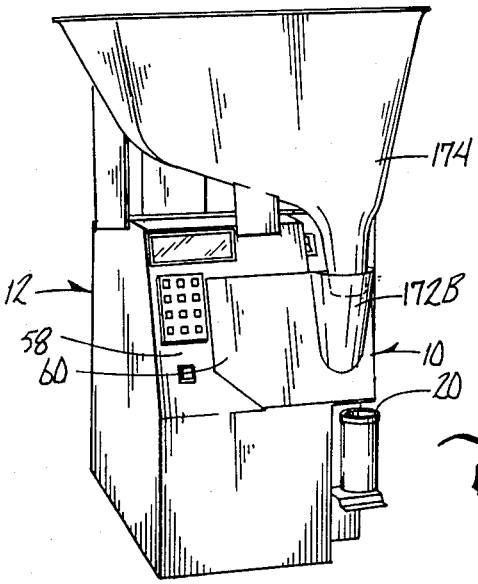
FIG. 10 is a perspective view of the cassette shown in FIG. 9 and an enlarged pill storage container positioned for loading the pill cassette during operation of the pill counting machine.

FIGS. 8–9 show alternate embodiments of cassette 10. In each case, an opening 170A or 170B is provided in the front side wall 60 of the cassette. A 172A or 172B is positioned over opening 170 such that cassette 10 can be continually loaded with additional pills from a storage bin 174 having a discharge spout, as shown in FIG. 10. A flexible piece of material 176 may be positioned over the opening in cassette 10 so as to normally close the opening when additional pills are not being fed into cassette 10.

In FIG. 8, opening 170A is shown as being elongated and extending across the front of cassette 10, with hopper 172A having a corresponding shape. In FIG. 9, opening 170B is located on the front of cassette 10 towards one end thereof with 172B having a corresponding shape. It is understood that the precise shape and location of the opening and the may take other variations as deemed desirable without departing from the scope of the invention as shown in the examples of FIGS. 8 and 9. Also, while storage bin 174 is shown in FIG. 10 to be positioned on top of machine 12, it is understood that such a bin can be located in any convenient position with communication from the bin to the being provided in any convenient manner.

From the foregoing, it is understood that the improved pill storage and dispensing cassette of the present invention accomplishes at least all of the stated objectives.

What is claimed is:

1. An improved pill storage and dispensing cassette for use with a pill counting maching having a vacuum source therein, said cassette including a front side wall, a back side wall, opposite end walls, a top wall and a bottom wall defining a storage chamber; a rotatable pill conveying wheel positioned in said back side wall and having a plurality of openings arranged annularly about the axis of rotation of said wheel for providing communication between said chamber and said vacuum source and for holding pills on said wheel upon actuation of said vacuum source; a discharge in opening in communication with said chamber; and a pill separator means positioned to operatively separate said pills from said wheel such that said pills are discharged through said discharge opening upon said wheel having conveyed said pills to said separator means; improvement comprising:

an adjustment means in said chamber adjacent said wheel and being movably adjustable to selectively extend across a portion of at least one of said openings in said wheel during rotation of said wheel whereby each opening is limited to holding a single pill;

an access opening in said front wall to allow an adjustment tool to extend across said storage chamber to said adjustment means for providing continuous adjustment of said adjustment means during operation of said machine; and a guide tube extending substantially between said access opening and said adjustment means to align said tool with said adjustment means and to prevent pills from falling out of said cassette through said access opening.

2. The cassete of claim 1 wherein said adjustment means includes a rotatable cam and a pivotable kick-off shoe having a cam follower surface for engagement with said cam whereby rotation of said cam causes said shoe to pivot for selective extension across a portion of one of said openings of said wheel.

3. The cassette of claim 2 wherein said cam and said cam follower surface each have a plurality of teeth for mating engagement with one another.

* * * * *